United States Patent [19]

DeBoer

[11] Patent Number: 5,017,547

[45] Date of Patent: May 21, 1991

[54] USE OF VACUUM FOR IMPROVED DENSITY IN LASER-INDUCED THERMAL DYE TRANSFER

[75] Inventor: Charles D. DeBoer, Rochester, N.Y.

[73] Assignee: Eastman Kodak Company, Rochester, N.Y.

[21] Appl. No.: 543,631

[22] Filed: Jun. 26, 1990

[51] Int. Cl.[5] ..... B41M 5/035; B41M 5/26

[52] U.S. Cl. ..... 503/227; 8/471; 428/195; 428/913; 428/914; 430/200; 430/201; 430/945

[58] Field of Search ..... 8/471; 428/195, 913, 428/914; 430/200, 201, 945; 503/227

[56] References Cited

U.S. PATENT DOCUMENTS

| | | | |
|---|---|---|---|
| 4,245,003 | 1/1981 | Oransky et al. | 428/323 |
| 4,772,582 | 9/1988 | DeBoer | 503/227 |
| 4,876,235 | 10/1989 | DeBoer | 503/227 |

FOREIGN PATENT DOCUMENTS

| | | | |
|---|---|---|---|
| 2083726 | 3/1982 | United Kingdom | 503/227 |

*Primary Examiner*—Bruce H. Hess
*Attorney, Agent, or Firm*—Harold E. Cole

[57] ABSTRACT

This invention relates to a process of forming a laser-induced thermal dye transfer image comprising:

(a) contacting at least one dye-donor element comprising a support having thereon a dye layer and an infrared-absorbing material with a dye-receiving element comprising a support having thereon a polymeric dye image-receiving layer, said dye-donor and dye-receiver being separated by a finite distance to create a space;

(b) imagewise-heating said dye-donor element by means of a laser; and (c) transferring a dye image to said dye-receiving element to form said laser-induced thermal dye transfer image, and wherein a vacuum is applied to said space between said donor and said receiver in order to minimize the mean free path the vaporized dye molecules travel without collision with other molecules for transfer to said receiver.

6 Claims, No Drawings

USE OF VACUUM FOR IMPROVED DENSITY IN LASER-INDUCED THERMAL DYE TRANSFER

This invention relates to the use of vacuum to improve the density in a laser-induced thermal dye transfer system.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Ser. No. 778,960 by Brownstein entitled "Apparatus and Method For Controlling A Thermal Printer Apparatus," filed Sept. 23, 1985, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

There is a problem with the laser dye transfer system described above in that the density of the transferred dye is not high as it should be. It would be desirable to provide a way to increase the density of the dye which is transferred by laser.

In U.S. Pat. No. 4,245,003, there is a disclosure of a laser apparatus having a vacuum holddown surface for use in holding down a receptor sheet so that it will be in intimate contact with a laser-imageable sheet comprising a transparent film coated with graphite particles in a binder. However, there is no disclosure in this patent that the two sheets should be separated or that use of a vacuum between the dye-donor and receiver during laser dye transfer will give improved transfer densities.

Accordingly, this invention relates to a process of forming a laser-induced thermal dye transfer image comprising:

(a) contacting at least one dye-donor element comprising a support having thereon a dye layer and an infrared-absorbing material with a dye-receiving element comprising a support having thereon a polymeric dye image-receiving layer, said dye-donor and dye-receiver being separated by a finite distance to create a space;

(b) imagewise-heating said dye-donor element by means of a laser; and (c) transferring a dye image to said dye-receiving element to form said laser-induced thermal dye transfer image, the improvement wherein a vacuum is applied to said space between said donor and said receiver in order to minimize the mean free path the vaporized dye molecules travel without collision with other molecules for transfer to said receiver.

The vacuum which is applied to the space between the dye-donor and dye-receiver should be at least about 50 mm Hg. As noted above, having the vacuum applied to the space between the dye-donor and dye-receiver reduces the mean free path that the vaporized dye molecules travel without collision with other dye molecules, thereby increasing the transferred dye density.

While any laser may be used in the invention, it is preferred to use diode lasers since they offer substantial advantages in terms of their small size, low cost, stability, reliability, ruggedness, and ease of modulation. In practice, before any laser can be used to heat a dye-donor element containing the infrared-absorbing material, the laser radiation must be absorbed within the dye layer and converted to heat by a molecular process known as internal conversion. Thus, the construction of a useful dye layer will depend not only on the hue, sublimability, quantity and absorbtivity of the image dye, but also on the ability of the dye layer to absorb the radiation and convert it to heat.

Lasers which can be used to transfer dye from dye-donors employed in the invention are available commercially. There can be employed, for example, Laser Model SDL-2420-H2 from Spectra Diode Labs, Laser Model SLD 304 V/W from Sony Corp. or Laser Model HL-8351-E from Hitachi.

A thermal printer which uses the laser described above to form an image on a thermal print medium is described and claimed in copending U.S. application Ser. No. 451,656 of Baek and DeBoer, filed Dec. 18, 1989, the disclosure of which is hereby incorporated by reference.

Spacer beads may be employed in a separate layer over the dye layer of the dye-donor in order to maintain the finite separation distance between the dye-donor and the dye-receiver during dye transfer. That invention is more fully described in U.S. Pat. No. 4,772,582, the disclosure of which is hereby incorporated by reference. The spacer beads may be coated with a polymeric binder if desired. Alternatively, the spacer beads may be employed in the receiving layer of the dye-receiver as described in U.S. Pat. No. 4,876,235, the disclosure of which is hereby incorporated by reference.

In a preferred embodiment of the invention, an infrared-absorbing dye is employed in the dye-donor element as the infrared-absorbing material instead of carbon black in order to avoid desaturated colors of the imaged dyes from carbon contamination. The use of an absorbing dye also avoids problems of uniformity due to inadequate carbon dispersing. For example, cyanine infrared absorbing dyes may be employed as described in DeBoer application Ser. No. 463,095, filed Jan. 10, 1990, the disclosure of which is hereby incorporated by reference. Other materials which can be employed are described in the following U.S. application Ser. Nos.: 366,970, 367,062, 366,967, 366,968, 366,969, 367,064, 367,061, 369,494, 366,952, 369,493, 369,492, and 369,491.

Any dye can be used in the dye-donor employed in the invention provided it is transferable to the dye-receiving layer by the action of the laser. Especially good results have been obtained with sublimable dyes such as anthraquinone dyes, e.g., Sumikalon Violet RS ® (product of Sumitomo Chemical Co., Ltd.), Dianix Fast Violet 3R-FS ® (product of Mitsubishi Chemical Industries, Ltd.), and Kayalon Polyol Brilliant Blue N-BGM ® and KST Black 146 ® (products of Nippon Kayaku Co., Ltd.); azo dyes such as Kayalon Polyol Brilliant Blue BM ®, Kayalon Polyol Dark Blue BM ®, and KST Black KR ® (products of Nippon Kayaku Co., Ltd.), Sumickaron Diazo Black 5G ® (product of Sumitomo Chemical Co., Ltd.), and Miktazol Black 5GH ® (product of Mitsui Toatsu Chemicals, Inc.); direct dyes such as Direct Dark Green B ® (product of Mitsubishi Chemical Industries, Ltd.) and Direct Brown M ® and Direct Fast Black D ® (products of Nippon Kayaku Co. Ltd.); acid dyes such as Kayanol Milling Cyanine 5R ® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.);

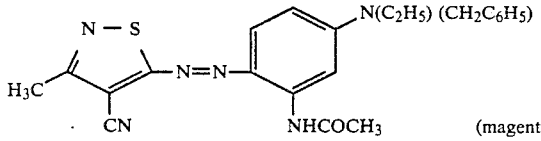

(magenta),

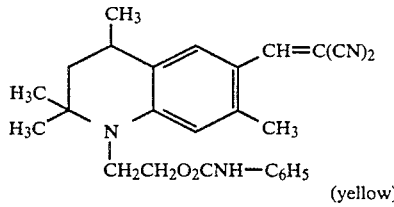

(yellow),

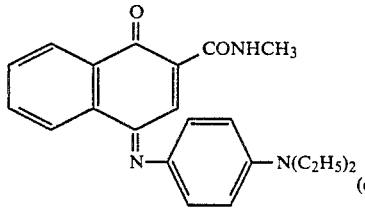

(cyan), or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference. The above dyes may be employed singly or in combination. The dyes may be used at a coverage of from about 0.05 to about 1 g/m$^2$ and are preferably hydrophobic.

The dye in the dye-donor employed in the invention is dispersed in a polymeric binder such as a cellulose derivative, e.g., cellulose acetate hydrogen phthalate, cellulose acetate, cellulose acetate propionate, cellulose acetate butyrate, cellulose triacetate or any of the materials described in U.S. Pat. No. 4,700,207; a polycarbonate; polyvinyl acetate, poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed theron by a printing technique such as a gravure process.

Any material can be used as the support for the dye-donor element employed in the invention provided it is dimensionally stable and can withstand the heat of the laser. Such materials include polyesters such as poly(ethylene terephthalate); polyamides; polycarbonates; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyether-imides. The support generally has a thickness of from about 5 to about 200 um. It may also be coated with a subbing layer, if desired, such as those materials described in U.S. Pat. Nos. 4,695,288 or 4,737,486.

The dye-receiving element that is used with the dye-donor element employed in the invention comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, white polyester (polyester with white pigment incorporated therein), an ivory paper, a condenser paper or a synthetic paper such as duPont Tyvek ®. In a preferred embodiment, polyester with a white pigment incorporated therein is employed.

The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

The following examples are provided to illustrate the invention.

EXAMPLE 1

(A) a cyan dye-donor element was prepared by coating the following layers on a 100 um unsubbed poly(ethylene terephthalate) support:

(1) Dye layer containing the cyan dye illustrated above (0.61 g/m$^2$), the infrared-absorbing dye A illustrated below (0.04 g/m$^2$), the infrared-absorbing dye B illustrated below (0.04 g/m$^2$), Dow Corning DC-510 ® surfactant (0.003 g/m$^2$) in a cellulose acetate propionate (2.5% acetyl, 46% propionyl) binder (0.27 g/m$^2$) coated from a butanone-dimethyl acetamide solvent mixture.

IR Absorbing Dye A

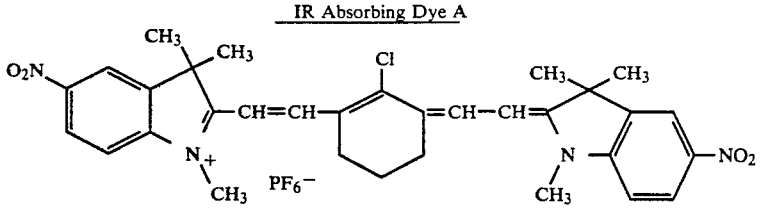

IR Absorbing Dye B

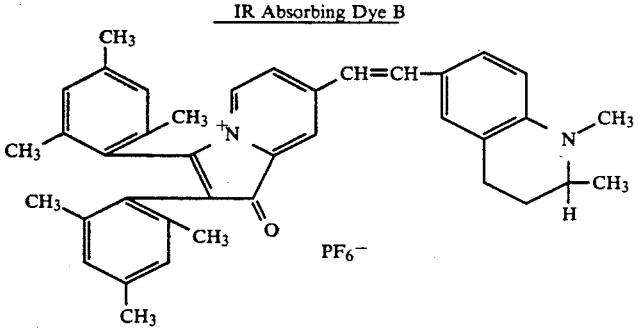

(2) Overcoat layer of cross-linked styrene-divinylbenzene-ethylstyrene beads (20 um diameter) (90% styrene content) (0.086 g/m$^2$) in Woodlok glue (a polyvinylacetate emulsion of United Resins) (0.022 g/m$^2$), sodium t-octylphenoxydiethoxyethane-sulfonate (0.002 g/m$^2$), nonylphenoxy polyglycidol (0.002 g/m$^2$), and tetraethylammonium perfluoro-octylsulfonate (0.002 g/m$^2$) coated from water.

A dye-receiving element was prepared by coating the following layers in order on a white reflective support of titanium dioxide-pigmented polyethylene overcoated paper stock:

(1) Subbing layer of poly(acrylonitrile-co-vinylidene chloride-co-acrylic acid) (14:80:6) (0.075 g/m$^2$) coated from butanone;

(2) Receiving layer of Makrolon 5700® bisphenol-A polycarbonate (Bayer AG) (2.9 g/m$^2$), Tone PCL-300® polycaprolactone (Union Carbide) (0.38 g/m$^2$) and 1,4-didecoxy-2,5-dimethoxybenzene (0.38 g/m$^2$) coated from methylene chloride; and (3) Overcoat layer of Tone PCL-300® polycaprolactone (Union Carbide) (0.11 g/m$^2$), Fluorad FC-431® surfactant (3M Corp.) (0.01g/m$^2$) and Dow Corning DC-510® surfactant (0.01 g/m$^2$) coated from methylene chloride.

A hollow rotating drum 9.4 cm in diameter was constructed with a pair of 2 mm wide and deep parallel grooves around the edge of the drum. There were two holes within the groves extending to the hollow center of the drum as a means to apply vacuum. The dye-receiver, 10 cm×15 cm, was placed face up on the drum between but not covering the two parallel grooves and taped with just sufficient tension to be held smooth. The dye-donor was cut oversize, 22 cm×29 cm, so as to cover the receiver and the parallel vacuum grooves and was placed face down upon the receiver and taped to the drum. Tape was also used to cover the 5 mm gap between the ends of the donor sheets. Since the dye-receiver is placed between the grooves where the vacuum is applied and the dye-donor is placed thereover, the vacuum to be applied will be effectively maintained in the space formed by the beads between the dye-donor and dye-receiver.

The assemblage of donor and receiver was scanned by a focused laser beam on the rotating drum at 280 rpm at a line writing speed of 1380 mm/sec. During scanning, vacuum was applied from a connection to the center of the drum using an oiless vacuum pump and recorded as differential pressure from atmospheric. The laser used was a Spectra Diode Labs Laser Model SDL-2420-H2® with a 20 um spot diameter and exposure time of 14 microseconds. The power was 108 milliwatts and the exposure power was 344 microwatts/square meter.

The cyan dye transferred to the receiver was read to Status A red density. The following results were obtained:

| Differential Vacuum (mm Hg) | Red Density |
|---|---|
| 0 (control) no vacuum | 2.0 |
| 120 | 2.2 |
| 720 (high vacuum) | 2.6 |

The above results show that improved transferred dye density is obtained at either moderate or high vacuum compared to laser scanning at atmospheric pressure (no vacuum).

EXAMPLE 2

(A) A cyan dye-donor element was prepared by coating on a 100 um unsubbed poly(ethylene terephthalate) support:

a dye layer containing the cyan dye illustrated above (0.59 g/m$^2$) and the cyan dye B illustrated below (0.59 g/m$^2$), the infrared-absorbing dye A illustrated above (0.12g/m$^2$), Dow Corning DC-510® surfactant (0.003 g/m$^2$) in a cellulose acetate propionate (2.5% acetyl, 46% propionyl) binder (0.36 g/m$^2$) coated from a butanone, cyclohexanone and dimethylformamide solvent mixture.

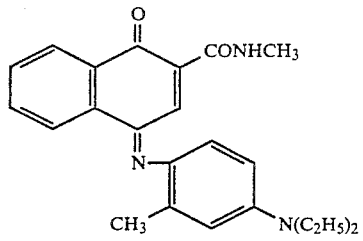

Cyan Dye B (B) A magenta dye-donor was prepared similar to the cyan dye-donor of (A) except that the magenta dye illustrated above was employed along with the magenta dye B illustrated below, each at 0.29 g/m$^2$.

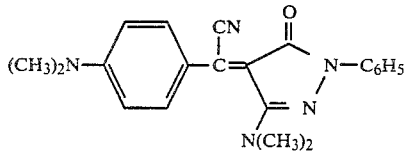

Magenta Dye B

A dye-receiving element was prepared by coating the following layers in order on a transparent support of polyethylene terephthalate:

(1) Receiving layer of Butvar 76® polyvinylbutyral (Monsanto Corp.) (4.2 g/m$^2$), triethanolamine (0.1 g/m$^2$) and Dow Corning DC-510® surfactant (0.004 g/m$^2$) coated from a butanone and cyclohexanone solvent mixture; and (2) Overcoat layer of cross-linked styrene-divinylbenzene-ethylstyrene beads (15 um diameter) (90% styrene content) (0.054 g/m$^2$) in Woodlok glue (a polyvinylacetate emulsion of United Resins) (0.022 g/m$^2$), sodium t-octylphenoxydiethoxy-ethanesulfonate (0.002 g/m$^2$), nonylphenoxy-polyglycidol (0.002 g/m$^2$), and tetraethylammonium perfluorooctylsulfonate (0.002 g/m$^2$) coated from water.

To enable a vacuum to be applied to the space between the dye-donor and the dye-receiver during laser thermal dye transfer, a flat bed apparatus was constructed. This involved a lower metal plate for holding the 3.5 cm×3.5 cm receiver and having a series of vacuum holes facing the back of the receiver to apply a vacuum. An upper flat metal plate with a center opening slightly larger than the receiver with edge holes to apply a vacuum to the outer edge of the oversized 7 cm×7 cm dye-donor was also involved. In this manner, the back of the dye-receiver is pressed down upon the metal block. Not only is face-to-face contact of donor and receiver promoted, but more importantly, the space between donor and receiver is evacuated. This vacuum between donor and receiver measured from the upper plate is critical and is tabulated as the difference in mm mercury from atmospheric (i.e., higher values as mm Hg are higher vacuum). This device does not permit evaluation at 0 vacuum (atmospheric pressure).

The assemblage of either magenta or cyan donor and receiver was placed face-to-face in the vacuum apparatus and was exposed to a galvanometer scanned focused 830 nm laser beam from a Hitachi single mode diode laser Model HL-8351-E through an F-theta lens. The spot area was an oval 7 um×9 um in size with the scanning direction along the long axis of the spot. The exposure time was 10 microseconds. The spacing between ovals was 8 um. The total area of dye transfer was 8 mm×36 mm. The power level of the laser was approximately 50 milliwatts and the exposure energy including overlap was 10 ergs/um$^2$ to obtain maximum density transfer. For each dye-donor, a stepped image was obtained by varying the power from 12 to 37 milliwatts. During scanning, vacuum was applied using an oiless vacuum pump and measured adjacent to the point of attachment near the upper plate.

After exposure, the dye-receiver was removed and the Status A red and green transmission densities were read. The following results were obtained:

| Differential Vacuum (mm Hg) | Power (mW) | Magenta Donor Green Density | Cyan Donor Red Density |
|---|---|---|---|
| 50 (low vacuum) | 16 | 0.62 | 0.21 |
| 200 | 16 | 0.58 | 0.21 |
| 390 | 16 | 0.67 | 0.23 |
| 750 (high vacuum) | 16 | 0.60 | 0.25 |
| 60 | 25 | 1.2 | 1.2 |
| 200 | 25 | 1.2 | 1.3 |
| 390 | 25 | 1.3 | 1.3 |
| 750 | 25 | 1.5 | 1.8 |
| 60 | 37 | 1.7 | 2.4 |
| 200 | 37 | 1.8 | 2.4 |
| 390 | 37 | 1.9 | 2.6 |
| 750 | 37 | 2.1 | 2.9 |

The above results show that for both cyan and magenta dye transfer, at both maximum and equivalent intermediate power levels, increased dye density is obtained.

The invention has been described in detail with particular reference to preferred embodiments thereof, but it will be understood that variations and modifications can be effected within the spirit and scope of the invention.

What is claimed is:

1. In a process of forming a laser-induced thermal dye transfer image comprising:

(a) contacting at least one dye-donor element comprising a support having thereon a dye layer and an infrared-absorbing material with a dye-receiving element comprising a support having thereon a polymeric dye image-receiving layer, said dye-donor and dye-receiver being separated by a finite distance to create a space;

(b) imagewise-heating said dye-donor element by means of a laser; and (c) transferring a dye image to said dye-receiving element to form said laser-induced thermal dye transfer image, the improvement wherein a vacuum is applied to said space between said donor and said receiver in order to minimize the mean free path the vaporized dye molecules travel without collision with other molecules for transfer to said receiver.

2. The process of claim 1 wherein said finite separation distance between said dye-donor and said dye-receiver is maintained by spacer beads which are employed in the dye-receiving layer of said dye-receiver.

3. The process of claim 1 wherein said finite separation distance between said dye-donor and said dye-receiver is maintained by spacer beads which are employed in an overcoat of said dye-donor element.

4. The process of claim 1 wherein said infrared-absorbing material is an infrared-absorbing dye.

5. The process of claim 1 wherein said laser is a diode laser.

6. The process of claim 1 wherein the amount of vacuum which is applied to said finite separation distance between said dye-donor and said dye-receiver is at least about 50 mm Hg.

* * * * *